United States Patent [19]

Schmidt

[11] Patent Number: 4,493,351

[45] Date of Patent: Jan. 15, 1985

[54] APPARATUS FOR COPY-MACHINING A WORKPIECE

[75] Inventor: Erich Schmidt, Mauerbach, Austria

[73] Assignee: MZW Maschinenfabrik Zuckermann Pachtgesellschaft mbH, Austria

[21] Appl. No.: 429,433

[22] Filed: Sep. 30, 1982

[30] Foreign Application Priority Data

Sep. 30, 1981 [DE] Fed. Rep. of Germany ..... 3138982

[51] Int. Cl.[3] ..... B27C 5/00; B23Q 35/04

[52] U.S. Cl. ..... 144/3 R; 144/137; 144/144 R; 144/144.5 R

[58] Field of Search ..... 144/3 R, 137, 144 R, 144/144 A, 144 B, 144 C, 144 D, 144.5 R; 142/7, 13, 15, 17, 18, 19, 20; 51/5 C, 5 B, 147; 409/92, 104, 105, 112, 122, 123; 29/28

[56] References Cited

U.S. PATENT DOCUMENTS 4,260,001 4/1981 De Muynck ..... 144/144 R 4,274,183 6/1981 Schmidt ..... 29/28

*Primary Examiner*—W. D. Bray

*Assistant Examiner*—Jorji M. Griffin

*Attorney, Agent, or Firm*—Finnegan, Henderson, Farabow, Garrett & Dunner

[57] ABSTRACT

Apparatus for copy-machining a workpiece includes a disk miller assembly acting as a shaping tool and a grinding belt extending between return pulleys and acting as a surface finishing tool assembly, both of the tool assemblies are mounted on pivot arms for pivotal displacement about pivot axes, carried on a common feed device and adapted to be advanced along a workpiece mounted in a clamping device under the control of a scanner scanning a model, the disk miller rotating about an axis extending parallel to the rotary axis of the workpiece as defined by the clamping device. The grinding belt is driven to rotate adjacent the disk miller in a plane extending parallel to the plane of rotation thereof. The pivot axis of the pivot arm associated with the grinding belt assembly is axially aligned with the pivot axis of the disk miller assembly.

9 Claims, 6 Drawing Figures

APPARATUS FOR COPY-MACHINING A WORKPIECE

BACKGROUND OF THE INVENTION

This invention relates to apparatus for copy-machining a workpiece, comprising a disk miller assembly acting as a shaping tool, and a grinding belt extending between return pulleys and acting as a surface finishing tool assembly, both said tool assemblies being mounted on pivot arms for pivotal displacement about pivot axes, carried on a common feed device and adapted to be advanced along a workpiece mounted in a clamping device, under the control of scanner means scanning a model, said disk miller rotating about an axis extending parallel to the rotary axis of said workpiece as defined by said clamping device.

Apparatus of the above-defined type is known for instance from DE-OS No. 28 21 788. This apparatus is employed for machining relatively long, low-contoured workpieces. Both the disk miller assembly as well as the grinding belt assembly are mounted on a carriage adapted to be displaced in the feed direction. While the disk miller has its rotary axis aligned parallel to the rotary axis of the workpiece, however, the rotary axes of the return pulleys carrying the grinding belt are aligned transversely to the rotary axis of the workpiece.

The known apparatus has been found useful, but it is not suitable, however, for accurately copy-machining deeply contoured workpieces of complicated shape.

It is thus an object of the present invention to improve the apparatus of the above mentioned type so as to enable it to machine deeply contoured, complicated workpieces in close adherence to the shape of a given model.

SUMMARY OF THE INVENTION

This object is attained by the provision that the grinding belt rotates adjacent the disk miller in a plane extending parallel to the plane of rotation thereof, and in that the pivot axis of the pivot arm associated with said grinding belt is axially aligned with the pivot axis of the disk miller.

The above provisions enable the grinding belt to perform machining movements identical to those of the miller assembly under the control of means scanning the model. It is thus even possible to accurately copy-machine relatively deep incisions as in the case, for instance, of the usually elaborately turned legs for rustic tables. Under the control of the scanning means scanning the model, the miller assembly carves the shape of the workpiece out of a solid blank, while the grinding belt smooths and finishes the surfaces shaped by the miller assembly.

The axial alignment with one another of the pivot axes of the arms carrying the disk miller and the grinding belt is a pre-requisite for machining the workpiece accurately to the same shape and dimensions as a given model.

In an advantageous embodiment the invention provides that the grinding belt and the disk miller are each mounted on their respective pivot arms in such a manner that a line passing through the contact point between the respective tool and the workpiece normal to the contact area of the respective tool extends substantially through the rotary axis of the workpiece. This provision results in a further improvement of the copy-maching accuracy adjacent the contact point of each tool. Due to this provision, both the disk miller and the grinding belt engage the workpiece in such a manner that the portions of the tools to both sides of their contact points enclose identical angles with a tangent of the workpiece passing through the respective contact point, irrespective of the workpiece diameter.

The control of the machining movements of both tool assemblies may be facilitated by the provision that both pivot arms are connected to guide arms of equal length associated with one and the same model and carrying a scanning element each. The employ of only a single model, such as a formpiece, a stencil or the like, ensures that both tools carry out identical working movements and precludes the possibility that the working coordinates of one tool diverge from those of the other tool due to unintentional shifting relative to one another of two models if employed for controlling the two tools independently of each other. This provision thus increases the working accuracy while contributing to the saving of costs. Any wear of the model affects both tools to the same degree, so that accurately identical movements of the tools are ensured even if the model gets worn.

A further advantageous simplification of the copy-machining operation results if the relationship between the distance between the scanning element and the pivot axis of each arm and the distance between the contact point on the workpiece and the respective pivot axis is 1:1. This permits the employ of a model having the same dimensions as the workpiece to be machined. It is thus possible to employ a fullsize handtooled workpiece as a model.

Particularly for the shaping of deep contours it is advantageous to have the grinding belt supported adjacent its contact point by a pressure shoe of acute-angular cross-section.

On the other hand, for finishing non-contoured or wide-contoured workpieces it may be advantageous to have the grinding belt supported by a spreading device.

For further improving the copy-working accuracy of the miller assembly and of the grinding belt it is advantageous if the pressure shoe or spreading device, respectively, is effective to guide the grinding belt at a salient angle between adjacent return pulleys. This provision precludes tangential contact of the grinding belt with the workpiece and ensures a substantially punctate work engagement of the grinding belt. In the case of a grinding belt rotating at high speed, this provision may also prevent burning of the workpiece material, for instance wood.

The working accuracy as well as the quality of the finished workpiece may be still further improved by rotating the machining tools and the workpiece in opposite directions.

DRAWINGS

An embodiment of the invention shall now be described with reference to the accompanying drawings, wherein.

DETAILED DESCRIPTION

Figure 1:
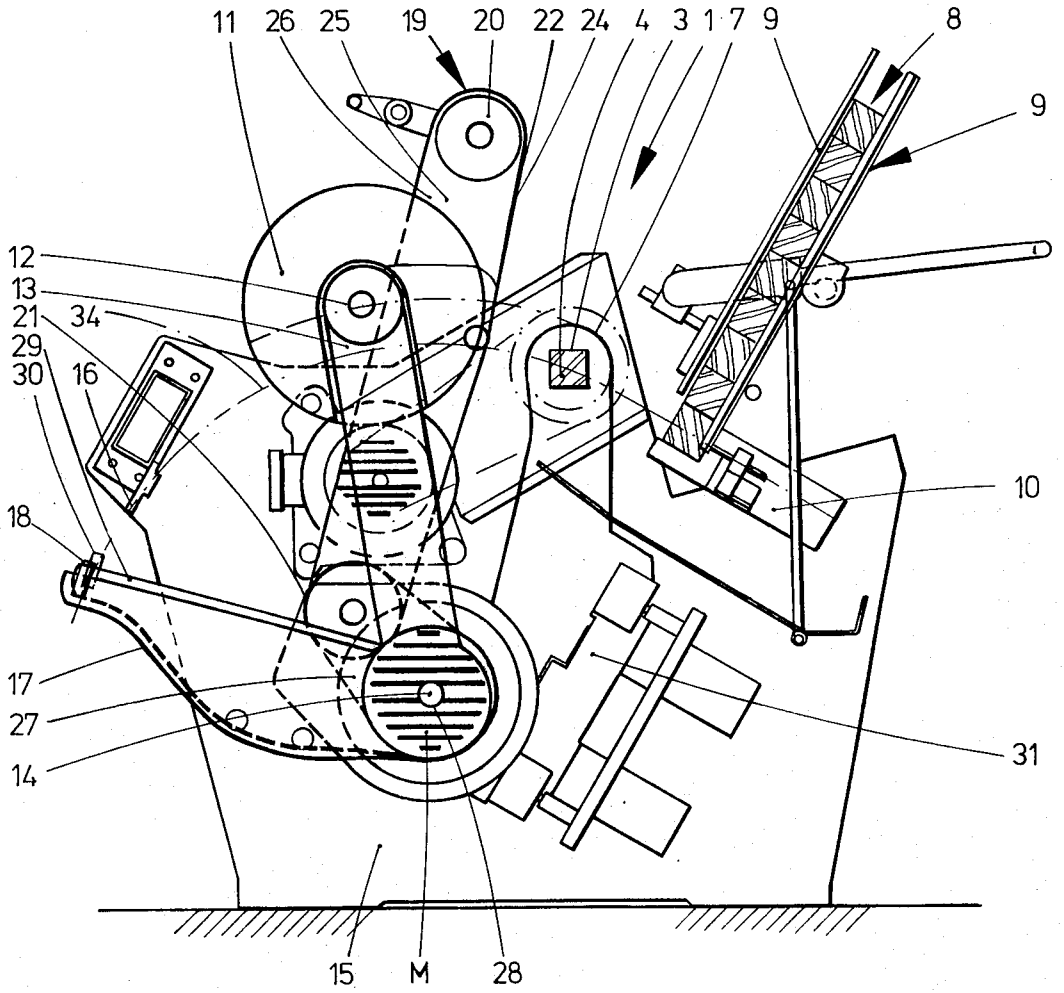
FIG. 1 shows a diagrammatic sideview of the main parts of apparatus according to the invention.
Figure 3:
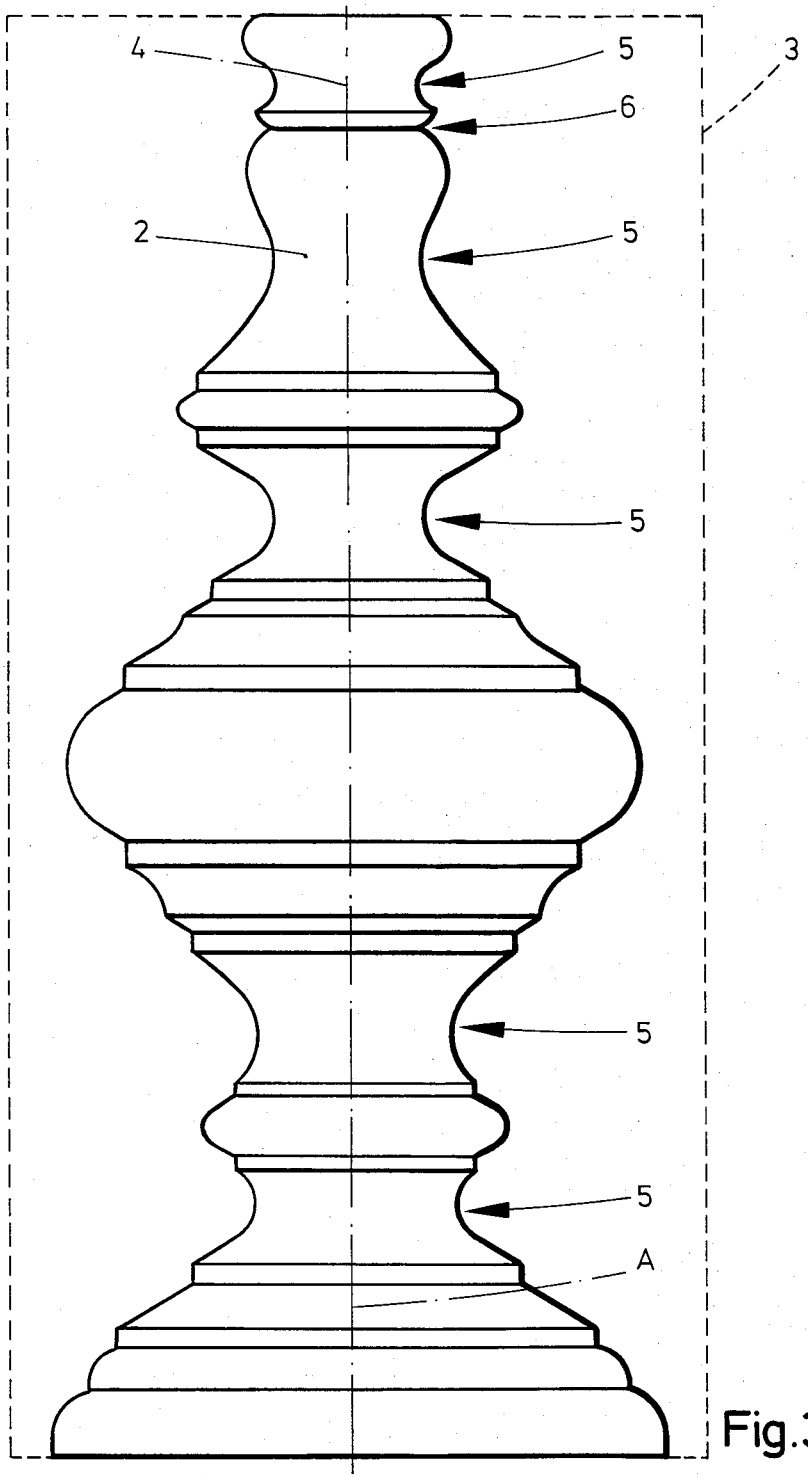
FIG. 3 shows a sideview of a deep-contoured workpiece.
Figure 4:
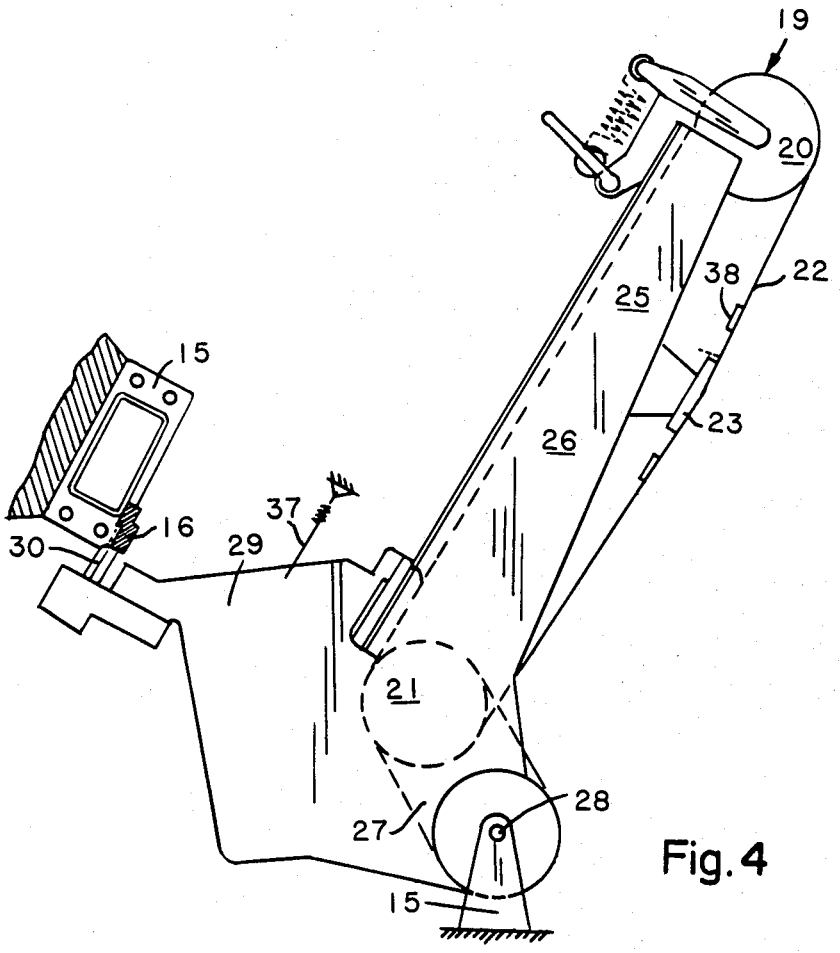
FIG. 4 is an isolated view of the grinding belt mechanism.
Figure 5:
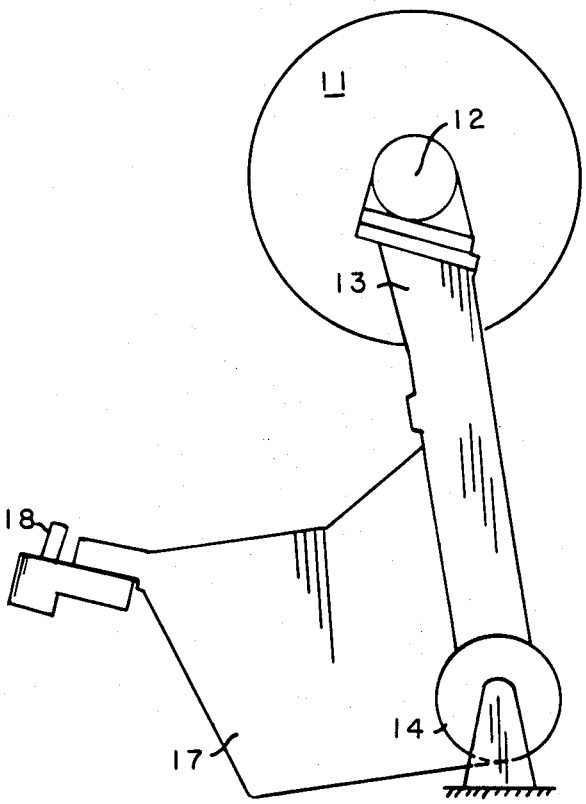
FIG. 5 is an isolated view of the disk miller mechanism.
Figure 6:
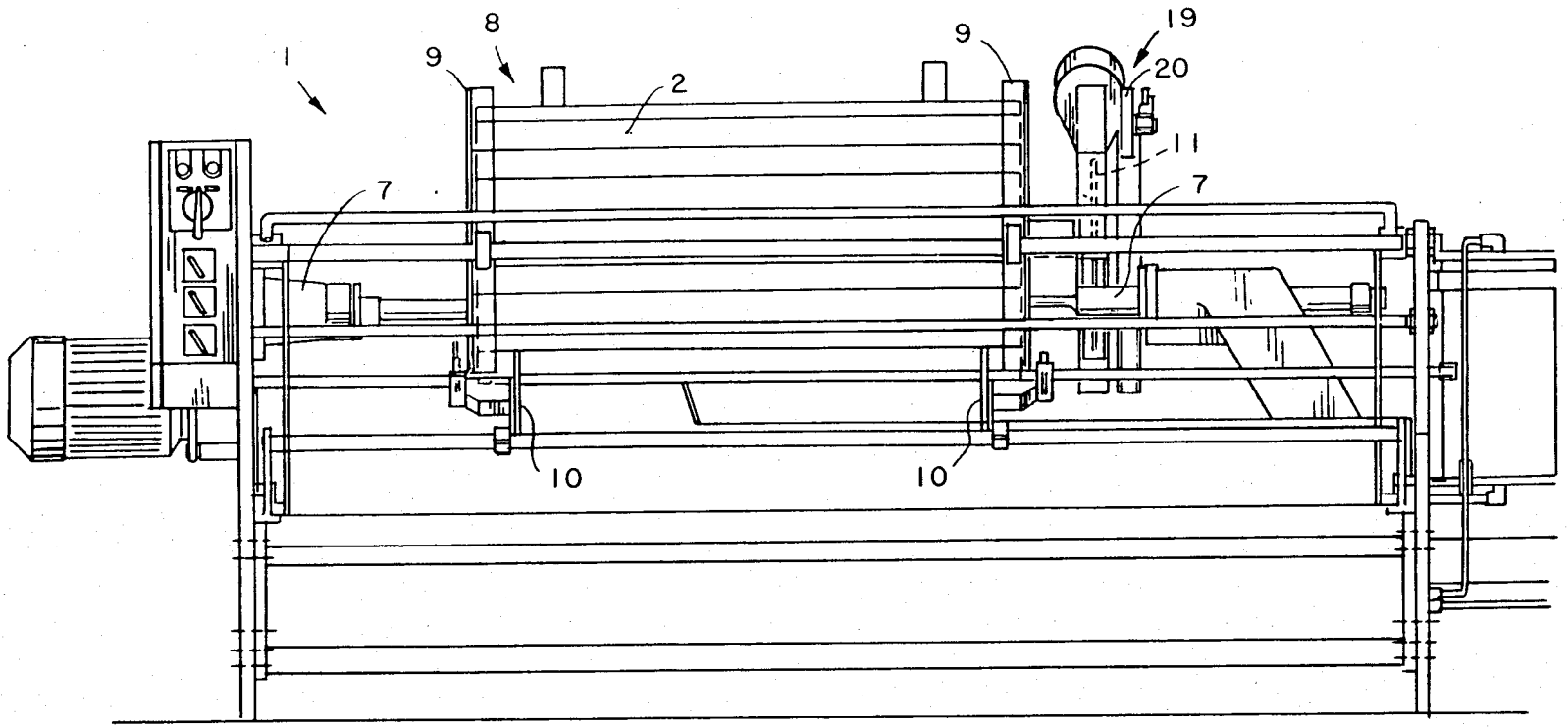
FIG. 6 is a side view of the apparatus as shown in FIG. 1.

Shown in FIG. 1 is an apparatus 1 for copy-machining a workpiece 2, details of which are shown in FIG. 3. In FIG. 1, workpiece 2 is shown in the form of a blank 3, the contours of which are shown in phantom lines in FIG. 3. The diameter of blank 3 is slightly greater than the greatest diameter of the finished workpiece 2 shown in FIG. 3. The axis A of blank 3 is at the same time the rotary axis 4 of workpiece 2. The workpiece shown is a candle-stick of rotation-symmetric configuration having a total of six restrictions 5 and 6. While restrictions 5 are of substantially rounded shape, restriction 6 is in the form of an acute-angled incision.

Instead of the square cross-section shown, blank 3 may also have a rectangular or round cross-sectional shape.

Blank 3 is mounted in the apparatus with its rotary axis 4 horizontal within a clamping device 7 adapted to be rotated by conventional drive means during the machining operation.

Located upstream of clamping means 7 is an automatic charging assembly 8 provided with parallel guide bars 9 retaining between them a supply of square-sectioned blanks to be successively introduced into the apparatus. Provided adjacent the lower ends of guide bars 9 are transfer elements 10 for inserting the lowermost blank into clamping device 7 after the preceding workpiece has been finished.

A disk miller 11 having an axis of rotation 12 parallel to the rotary axis 4 of workpiece 2 is mounted on a pivot arm 13 itself mounted on a frame 15 of the apparatus for pivotal movement about a pivot axis 14 parallel to rotary axis 4.

Disk miller assembly 11 is employed as a shaping tool, the copy-machining movements of which are controlled with the aid of a model or pattern-piece 16. In the present case, model 16 is in the form of a stencil fixedly attached to frame 15.

Figure 2:
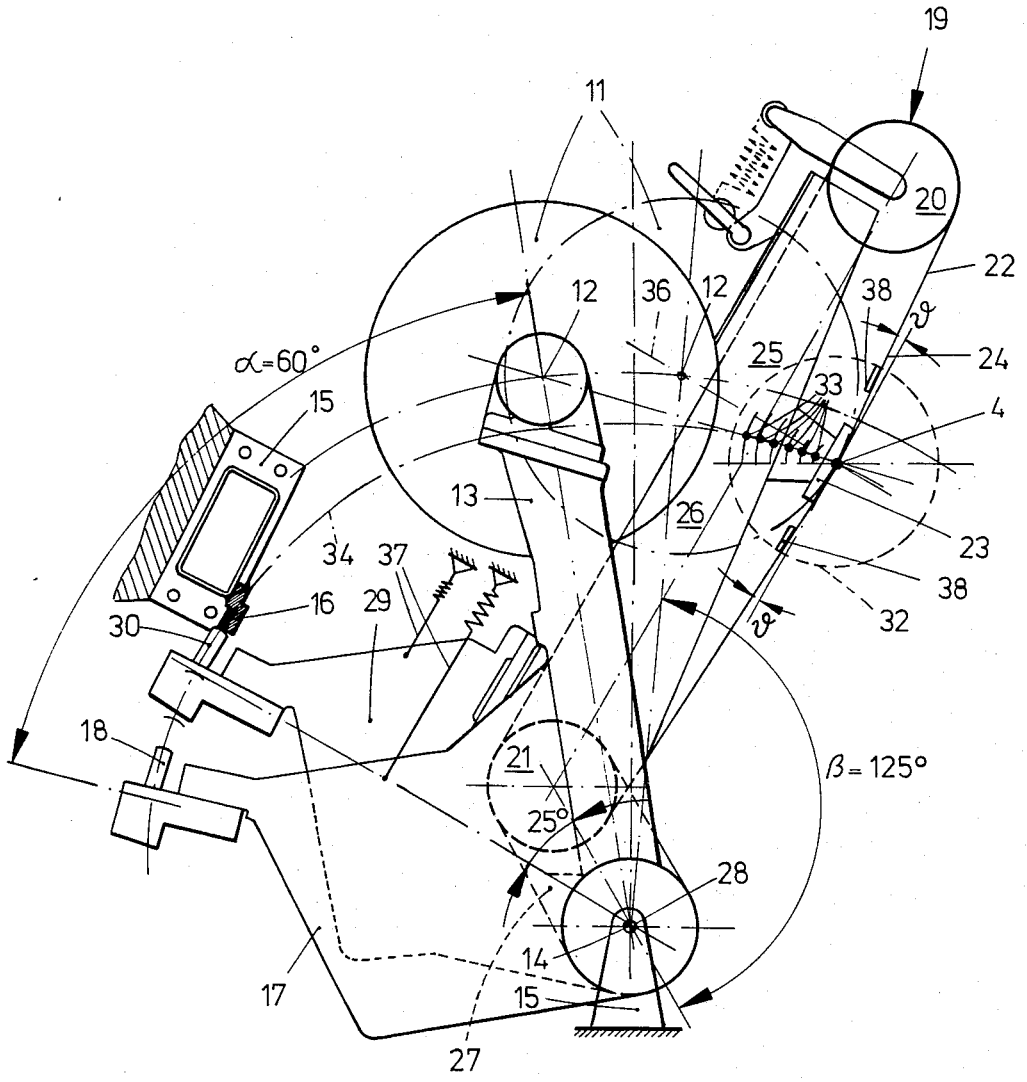
FIG. 2 shows a detailed sideview of the disk miller and grinding belt assemblies as well as the mounting and copy-machining control arrangement thereof.

For scanning model 16, pivot arm 13 is connected to a guide arm 17 carrying a scanning element 18 in the form of a scanning pin adjacent its free end. As shown in FIG. 2, guide arm 17 is releasably connected to pivot arm 13 and encloses an angle of about 60° therewith.

Mounted adjacent disk miller assembly 11 is a grinding belt assembly 19 comprising a grinding belt 22 extending around a pair of return pulleys 20 and 21. Grinding belt 22 has its work-engaging portion supported by a pressure shoe 23 as shown in detail in FIG. 2. Pressure shoe 23 is of acute-angular cross-section and is effective to guide the work-engaging portion 24 at a salient angle between return pulleys 20 and 21. As a result of the acute-angular cross-section of pressure shoe 23, the work-engaging portion of grinding belt 22 is maintained in an acute-angular configuration, whereby it is enabled to surface-finish relatively narrow and deep restrictions such as the incision 6 of the workpiece shown in FIG. 3.

Return pulleys 20 and 21 are mounted adjacent respective ends of a first portion 25 of an L-shaped pivot arm 26, a second portion 27 of which is connected to frame 15 for pivotal movement about a pivot axis 28 disposed in axial alignment with the pivot axis 14 of the milling assembly. First and second portions 25 and 27, respectively, of arm 26 enclose an angle of about 125° between themselves.

The copy-movements of grinding belt assembly 19 are likewise controlled by a guide arm 29 acting between model 16 and pivot arm 26. Guide arm 29 is of substantially the same design as guide arm 17 and carries a scanning element in the form of a scanner pin 30 adjacent its free end. Guide arm 29 encloses an angle of about 25° with second portion 27 of pivot arm 26, as indicated in FIG. 2.

Both guide arms 17 and 29 are of substantially equal length, i.e. the distance between scanning element 18 and pivot axis 14 is the same as the distance between scanning element 30 and pivot axis 28. The scanning elements of both guide arms scan one and the same model 16, although in a laterally offset arrangement corresponding to that of the two tool assemblies 11 and 19. Disk miller assembly 11 is arranged forward of grinding belt assembly 19 in the feed direction, as the milling operation is to be carried out before the grinding operation.

Both tool assemblies are adapted to be driven by drive means M. In order to achieve high-accuracy shaping work as well as a high-quality surface finish it is preferred according to the invention to rotate the grinding tool assembly in a direction opposite to that of the rotation of the workpiece. The milling tool assembly may rotate in the same direction.

In the present case the ratio between the cutting speed of the milling tool assembly and the mean circumferential speed of the workpiece is about 33:1, the milling tool rotating with a circumferential speed of about 100 m/sec, while the mean circumferential speed of the workpiece is about 3 m/sec.

The pivot arms of both tool assemblies are mounted on a common feed device in the form for instance of a carriage 31 adapted to be driven in the feed direction for machining the workpiece.

For the following description of the control geometry of the tool assemblies, reference is taken particularly to FIG. 2.

In this figure as well as in FIG. 1, the workpiece axis 4 extends normal to the plane of the drawing. In FIG. 2, workpiece axis 4 is indicated by a dot surrounded by a circular phantom line indicating the largest possible diameter of the workpiece.

Disk miller assembly 11 is shown in two positions, namely, in its standby position drawn in full lines, and in its operating position with respect to a workpiece having a diameter O, as drawn in phantom lines.

In the last-named position, the contact point between the periphery of disk miller 11 and the assumed workpiece having the diameter=O coincides exactly with the workpiece axis 4. A number of contact points 33 for a corresponding number of intermediate workpiece diameters are indicated between axis 4 and the phantom line 32 indicating the largest possible workpiece diameter. The contact points 33 are located on a circular arc 34 extending through both the model 16 and the workpiece axis 4 with the pivot axes 14 and 28 as its center. Due to this arrangement the distance between the scanning elements 18, 30 and the pivot axis 14 and 28, respectively, of the pivot arms carrying the tool assemblies is exactly the same as the distance between the contact points 33 on the workpiece and the respective pivot axes 14, 28.

The disk miller 11 is mounted on its pivot arm 13 in such a manner that a line passing though its contact point with any workpiece normal to the contact area extends substantially through the workpiece axis of rotation 4 and through the rotary axis 12 of disk miller 11. As a result, the tool portions to both sides of any contact point always enclose equal angles with a tangent passing through the contact point on the workpiece, irrespective of the diameter of the latter. In the example shown, the distance between the rotary axis 12 of disk miller 11 and pivot axis 14 of arm 13 is somewhat greater than the radius of circular arc 34. Due to this arrangement both the milling tool assembly 11 and the grinding belt assembly 19 engage the workpiece from one side thereof at a somewhat elevated position. This leaves the opposite side of the workpiece axis free for the introduction of consecutive workpieces and permits the finished workpieces to be discharged from the apparatus by gravity.

In concurrence with the arrangement of the disk miller, grinding belt assembly 19 is mounted on its pivot arm 26 in such a manner that a line passing through any given contact point 33 normal to the work-engaging portion of the tool extends substantially through the workpiece axis of rotation 4.

This arrangement ensures that the work-engaging portions of both tools engage the workpiece at analogous contact points, whereat the tool portions extending away from such contact point on both sides thereof enclose equal angles with a workpiece tangent passing through the contact point. In FIG. 2 this is indicated with respect to the work-engaging portion 24 of grinding belt 22 by the two identical angles. The grinding belt assembly is shown in its operating position in engagement with an imaginary workpiece having a diameter=O. The contact point between the work-engaging portion 24 of grinding belt 22 and the assumed workpiece is thus located on the workpiece axis 4. As grinding belt 22 is supported at a salient angle by pressure shoe 23, the belt portions on both sides of the contact point each enclose the angle with the tangent T passing through the contact point. The previously mentioned line 36 extends normal to tangent T and further through rotary axis 12 of disk miller assembly 11 in its working position as indicated in phantom lines.

The mounting of grinding belt assembly 19 on an angular pivot arm 26 ensures that its contact point with the workpiece is always analogous to that of disk miller 11, irrespective of the workpiece diameter. This ensures analogous operation of the two tool assemblies and thus identical copying of the shape determined by model 16.

The guide arms 17 and 29 or the scanning elements 18 and 30, respectively, are connected to the respective pivot arms 13 and 26 in such a manner that the radial movements of the scanning elements on the one side are in harmony with those of the tool assemblies on the other side. Radial movement of the scanning elements in the clockwise direction will thus result in corresponding clockwise movements of the tool assemblies.

Both tool assemblies are biased into the work-engaging position by springs 37. Retractor means (not shown) are provided for retracting the tool assemblies to standby positions as shown in FIG. 2 for disk miller assembly 11.

Operation of the apparatus according to the invention is initiated by clamping a blank of for instance square cross-sectional form in clamping device 7. Both the disk miller assembly 11 and grinding belt assembly 19 are initially retracted to their standby positions out of contact with the blank, which is then started to rotate in clockwise direction.

At the same time, the tool assemblies are likewise started to rotate at a peripheral speed which is a multiple of that of the workpiece.

The tool assemblies are then advanced to their operating positions adjacent one end of the workpiece to start the machining thereof under guidance along model 16. The disk miller assembly 11 acts as a shaping tool and imparts the contours determined by model 16 to workpiece 2. Grinding belt assembly 19 trails the disk miller assembly under guidance along the same model 16 with a certain delay and acts to finish the surface of workpiece 2.

The feed movement of the two tool assemblies is carried out by the common carriage 31 on which the tool assemblies are mounted with their pivot arms 13 and 26. At the end of the machining operation, the tool assemblies are retracted from the workpiece by the associated retractor means, whereupon the clamping device releases the workpiece and drops it out of the apparatus.

The particular arrangement of the disk miller assembly and the grinding belt assembly together with the configuration of the grinding belt permits deep-contoured workpieces to be copy-machined and ground with high accuracy. For the finishing of low-contoured surface areas the grinding belt 22, which is guided over the acute-angular pressure shoe 23, may be flattened or spread out as by the use of spreading sliders 38 to be inserted on both sides of the pressure shoe.

The invention is not restricted to the machining of wooden workpieces. It is also applicable to the shaping of workpieces of other materials having similar cutting properties.

I claim:

1. In an apparatus for copying-machining a workpiece, including a disk miller assembly acting as a shaping tool and a grinding belt extending between return pulleys and acting as a surface finishing tool assembly, both said tool assemblies being mounted on pivot arms for pivotal displacement about pivot axes and adapted to be advanced along a rotating workpiece in sequence under the control of scanner means scanning a model, said disk miller rotating about an axis extending parallel to the rotary axis of the workpiece, the improvement wherein said grinding belt rotates between said pulleys adjacent to said disk miller with the axis of the pulleys being parallel to the rotary axis of the workpiece and with the pivot axis of the pivot arm of the grinding belt being co-axial with the pivot axis of the pivot arm of the disk miller.

2. Apparatus according to claim 1, wherein said grinding belt and said disk miller are mounted on their respective pivot arms in such a manner that a line passing through the contact point between the belt and the workpiece and between the miller and the workpiece normal to the surface of the workpiece extends substantially through the rotary axis of said workpiece.

3. Apparatus according to claims 1 or 2, wherein both pivot arms are connected to guide arms of equal length both of which are associated with one and the same model and each carrying a scanning element.

4. Apparatus according to claim 3, wherein the distance between the scanning element and the pivot axis of each pivot arm is equal to the distance between the respective contact points of the grinding belt and the disk miller with the workpiece and the pivot axis of each pivot arm.

5. Apparatus according to claim 1, wherein said grinding belt is supported adjacent its contact point by a pressure shoe of acute-angular cross section.

6. Apparatus according to claim 1, wherein said grinding belt is adapted to be supported adjacent its contact point by a spreading device for machining non-contoured or wide-contoured workpieces.

7. Apparatus according to claims 5 or 6, wherein said pressure show or spreading device guides said grinding belt at a salient angle between the return pulleys.

8. Apparatus according to claim 1, wherein the relationship between the cutting speed of the disk miller and the mean circumferential speed of the workpiece is between 20:1 to 50:1.

9. Apparatus according to claim 1, wherein the grinding belt and the workpiece are rotated in opposite directions.

* * * * *